US008122752B2

(12) United States Patent
Yamamoto et al.

(10) Patent No.: US 8,122,752 B2
(45) Date of Patent: Feb. 28, 2012

(54) DISCARD CONVEYING APPARATUS

(75) Inventors: Takeharu Yamamoto, Yamaguchi (JP); Yasuo Katoh, Yamaguchi (JP)

(73) Assignee: Ube Machinery Corporation, Ltd. (JP)

( * ) Notice: Subject to any disclaimer, the term of this patent is extended or adjusted under 35 U.S.C. 154(b) by 550 days.

(21) Appl. No.: 12/374,225

(22) PCT Filed: Jul. 17, 2007

(86) PCT No.: PCT/JP2007/064389

§ 371 (c)(1),
(2), (4) Date: Jan. 16, 2009

(87) PCT Pub. No.: WO2008/010586

PCT Pub. Date: Jan. 24, 2008

(65) Prior Publication Data

US 2009/0320549 A1 Dec. 31, 2009

(30) Foreign Application Priority Data

Jul. 20, 2006 (JP) ..... 2006-198232

(51) Int. Cl.
*B21D 45/00* (2006.01)

(52) U.S. Cl. ..... 72/427

(58) Field of Classification Search ..... 72/257, 72/361, 426, 427, 254, 255, 419; 29/50, 29/47, 61, 91, 93, 94, 96, 102; 83/167, 157, 83/165, 160; 198/703, 468.9
See application file for complete search history.

(56) References Cited

U.S. PATENT DOCUMENTS

| | | | | |
|---|---|---|---|---|
| 3,838,589 | A * | 10/1974 | Behrendt | 72/257 |
| 4,050,278 | A * | 9/1977 | Asano et al. | 72/257 |
| 4,825,677 | A * | 5/1989 | Bessey et al. | 72/270 |
| 6,305,207 | B1 | 10/2001 | Jakoby | |

FOREIGN PATENT DOCUMENTS

| | | | |
|---|---|---|---|
| JP | 5-49111 | U | 6/1993 |
| JP | 2001-513447 | A | 9/2001 |

* cited by examiner

*Primary Examiner* — Shelley Self
(74) *Attorney, Agent, or Firm* — DLA Piper LLP (US)

(57) ABSTRACT

A discard conveying apparatus comprising a chute provided below a die of an extrusion pressing machine in which discards are freely dropped along the chute through which the discards are guided, in which the discard conveying apparatus comprises a chute having a discharging port in a position which is approximately just under the dies, a bucket for containing the discards disposed in the discharging port of the chute, and a transporter capable of freely moving the bucket in a forward and backward direction, the transporter being attached to a machine base in the direction of crossing to an axis line of the machine base in the manner of being passed through the machine base and supporting an inversion axis of the bucket, and the bucket is turned and inversed when the bucket is transported to an end portion of the forward movement.

6 Claims, 3 Drawing Sheets

DISCARD CONVEYING APPARATUS

TECHNICAL FIELD

The present invention relates to an apparatus for recovering a discard of extruded products in the production of the extruded products in an extrusion pressing machine, in which the discard of the extruded products is a tag end portion of the product recovered after cutting the tag end portion from each product. More specifically, the present invention relates to a discard conveying apparatus for use in a extrusion pressing machine in which after cutting, the separated discards are guided to a chute section of the extrusion pressing machine and are freely fallen through the chute section, and then the recovered discards are conveyed to the outside of the extrusion pressing machine.

BACKGROUND ART

Generally, when a metal material such as aluminum or an alloy thereof is extruded on an extrusion pressing machine to produce extruded products (billets), the billets, after casting and cutting to a predetermined length, are heated to a predetermined temperature on a heating means such as billet heater, and are then charged in a container, while being maintained in a heated state. After removal of air from the container, the billets are forwardly moved under application of pressure using an extrusion stem, and the products are extruded from an opening of the dies attached to the extrusion pressing machine.

However, during extrusion of the billets, when a length of the remaining portion or remainder of the billets which is not introduced in the extrusion pressing machine is reduced, a tendency of incorporating an oxide occurs, salting-out product and air, appearing on an outer surface of the billets, into a center portion of the billets, because during the extrusion process, a friction resistance in the billet material is smaller than a resistance in the contact surface between a surface layer of the billets and the container, and a flow of the surface layer of the billets is slower than that of the center portion of the billets. Accordingly, Japanese Unexamined Utility Model Publication (Kokai) No. 5-491111 describes use of a direct operating-type extrusion pressing machine 80 provided with a handling apparatus 90 for a discard 14. In this extrusion pressing machine 80, in order to prevent the production of the defective products as a result of the deposition of an oxide, a salt-outing product and others on the products, a forward moving of the extrusion stem 81 is stopped while maintaining a certain length of the remainder, i.e., discard 14, and, after the discard 14 is discharged from the container 82, a shearing apparatus 83 is operated to separate the discard 14 from the products by cutting. Thereafter, the discard 14 separated from the products is dropped from a lower portion of the dies 12 through the chute 86, slope-wise disposed in a machine base 15, to a conveyer apparatus 91 disposed along the extrusion pressing machine 80. The dropped discard 14 is then conveyed to a discard recovering means 92.

However, according to this prior art method, an increase of the dropping distance is required when the discards are dropped, because the discards, after cutting, have to be dropped from a lower portion of the dies 12 through the chute 86, slope-wise disposed in a machine base 15, to a conveyer apparatus 91 disposed along the extrusion pressing machine 80. Therefore, a discharge port 17 of the chute 86 and a conveyer apparatus 91 have to be disposed in a pit 87 which is positioned at a lower level than the level of the floor on which a machine base 15 is installed. Further, it is necessary to produce a large scale handling apparatus 90 comprising a conveyer apparatus 91 and a discard recovering means 92 for recovering a discard 14, thereby causing problems, such as an increase in costs in the production of the apparatus and in machines installed on the foundation.

Further, since the structure and configuration of the chute 86 are complicated, a problem arises in that the discard 14 can be catched and stopped in a guiding passage of the chute 86, thereby causing a problem that the discard 14 cannot be dropped to the conveyer apparatus 91 form the extruding pressing machine 80.

DISCLOSURE OF THE INVENTION

The present invention is intended to solve the problems described above, and an object thereof is to provide a discard conveying apparatus for use in an extrusion pressing machine having a downsized scale and capable of reducing the cost of the machines installed, in addition to having the capability of conveying the freely dropping discards at a high reliability from the extrusion pressing machine to an outside thereof, even if the applied dropping distance is reduced in comparison with that of the prior art discard conveying apparatuses.

According to the present invention, the above object can be attained by a discard conveying apparatus comprising a chute provided below a dies of an extrusion pressing machine in which discards are freely dropped along the chute through which the discards are guided, in which the discard conveying apparatus comprises:

- a chute having a discharging port in a position which is approximately just under the dies,
- a bucket for containing the discards disposed in the discharging port of the chute, and
- a transportation means capable of freely moving the bucket in a forward and backward direction, the transportation means being attached to a machine base in the direction of crossing to an axis line of the machine base in the manner of being passed through the machine base and supporting an inversion axis of the bucket, and
- the bucket is turned and inversed when the bucket is transported to an end portion of the forward movement.

Further, in the discard conveying apparatus according to the present invention, it is preferable that the bucket is subjected to a turning movement by stopping a movement of an arm, provided on the inversion axis, by a stopper in the process of moving the transportation means and before arrival of the transportation means at the end portion of the forward movement, thereby controlling the movement of the arm, followed by forwardly moving the bucket through the stopped arm.

Furthermore, in the discard conveying apparatus according to the present invention, it is preferable that the transportation means of the bucket comprises a buffer means for absorbing a dropping energy of the discards.

Moreover, in the discard conveying apparatus according to the present invention, it is preferred that the buffer means comprises a suspension apparatus for the bucket having an elastic element disposed in at least four corners of the transportation means by which the inversion axis is supported, and a pressure-receiving element comprising a rubber-like elastic body which is disposed in a position below the discharging port of the chute and to which the bucket is contacted through the transportation means, and the buffer means can absorb the dropping energy of the discards as a result of the deformation of the elastic body.

BEST MODE FOR CARRYING OUT THE INVENTION

Next, the embodiments of the discard conveying apparatus for the extrusion pressing machine according to the present invention will be explained referring to FIGS. 2 and 3. Note that FIG. 2 is an illustration explaining a general outline of the preferred extrusion pressing machine of the present invention, and FIG. 3 is a cross-sectional view showing a line A cutting surface and a line B cutting surface of the extrusion pressing machine of FIG. 2.

Figure 1:
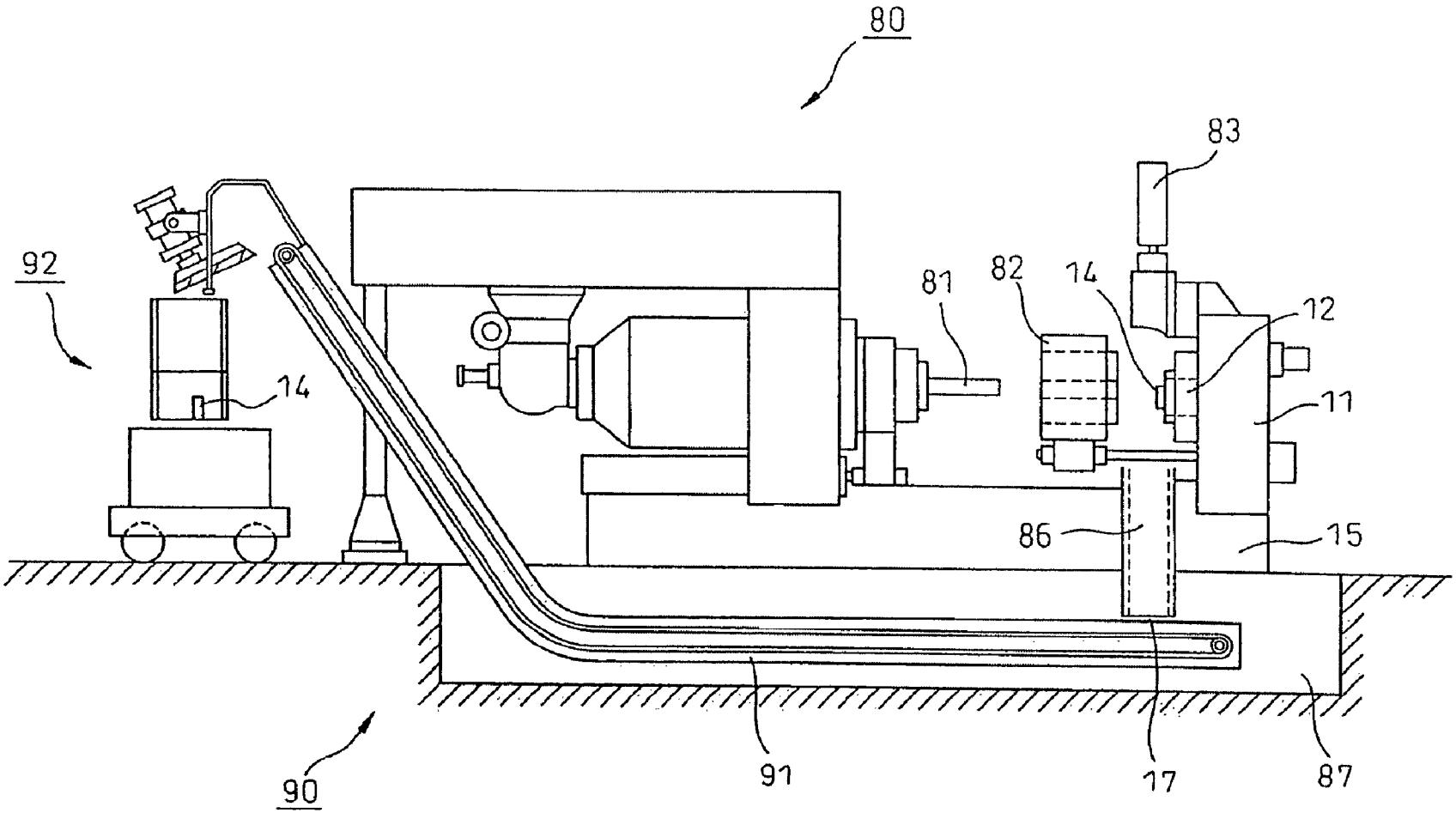
Fig.1 PRIOR ART
FIG. 1 is a side view illustrating the constitution of the prior art extrusion pressing machine.
Figure 2:
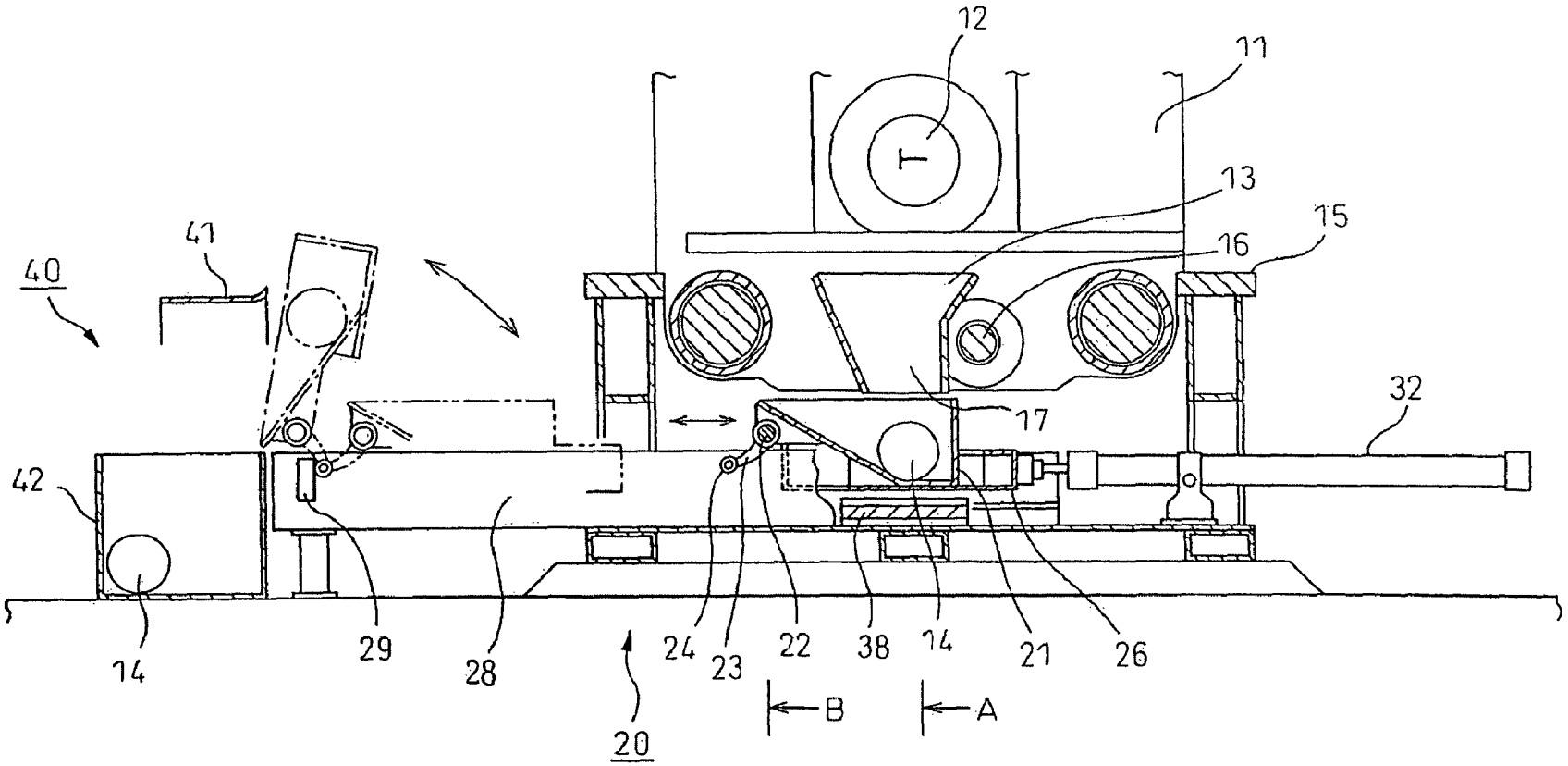
FIG. 2 is a schematic view showing one preferred example of the extrusion pressing machine according to the present invention.
Figure 3:
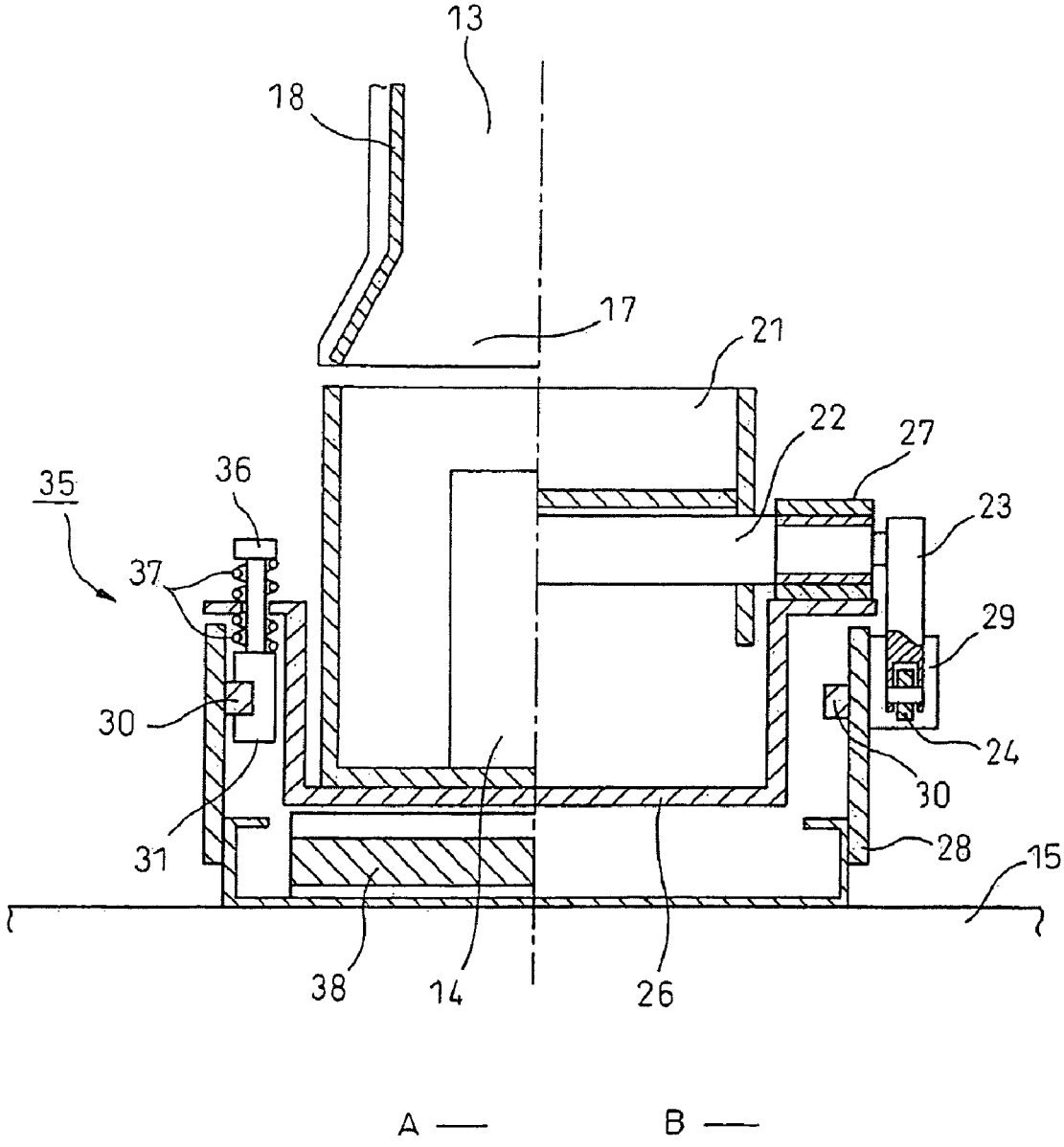
FIG. 3 is a cross-sectional view showing a line A cutting surface and a line B cutting surface of the extrusion pressing machine shown in FIG. 2.

The general outline of the preferred extrusion pressing machine according to the present invention is shown in FIGS. 2 and 3. As shown in FIG. 2, an end platen 11 is disposed along one end portion of the machine base 15 in such a manner that the end platen 11 can be freely slided with contacting in a direction of the extrusion axis line, and a dies 12 is disposed on the end platen 11 wherein an outer peripheral surface of the dies 12 is slidably intruded and maintained in an inner peripheral surface of the die cassette.

Reference numeral 13 represents a chute 13 fixedly disposed on the end platen 11 which was disposed below the dies 12. Further, the chute 13 has an opening opened to a near side of the illustrated machine (side of a container) and has a horizontal cross-sectional profile of approximately horseshoe. An apron 18 (FIG. 3) attached to a container holder (not shown) is contained in the opening of the chute 13. The apron 18 is constituted such that it can form a receiving and discharging port 17 as a result of the forward and backward movement of the container holder, thereby enabling to guide the cut and freely dropping discards 14.

Reference numeral 16 represents a piston rod of the cylinder for transporting a container holder. Using the piston rod 16, a container is freely contacted with and separated from the dies 12.

Reference numeral 21 represents a bucket which comprises an inversion axis 22 fixed to the bucket 21, an arm 23 fixed to the inversion axis 22 and a roller 24 rotatably attached to a tip portion of the arm 23. The bucket 21 is supported with an axis bearing 27 disposed on a transportation frame 26, and can contain the freely dropping discards 14 guided through the chute 13 and the apron 18.

Reference numeral 20 represents a transportation means, and is constituted such that the transportation frame 26 and the bucket 21 can be moved in the forward and backward direction with free driving through a suspension apparatus 35 disposed in a guide 31 which is guided to a guide rail 30 attached to a guide frame 28. Accordingly, the transportation means 20 can convey the discards 14 from an inside of the extrusion pressing machine to an outside of the extrusion pressing machine.

A driving means 32 illustrated herein has a constitution that the driving means 32 is attached to the machine base 15 using a fluid pressure cylinder so that it can be freely moved with oscillation. However, in place of the driving means, any other means capable of causing a linear reciprocal operation such as a driving means using a motor with a ball screw and a ball bushing and a driving means using a winding and hanging mechanism. Accordingly, the driving means 32 can move the transportation frame 26 and the bucket 21 back and forth.

As is illustrated in FIG. 3, the suspension apparatus 35 is basically constituted from an elastic element 37 sandwiching a flange portion of the transportation frame 26 and a guide axis 36. The suspension apparatus 35 is intended to absorb an impact energy applied when the discards 14 are dropped in the bucket 21, thereby moderating a transmittance of the impact strength to the discard conveying apparatus. The elastic element 37 illustrated herein has a constitution using a coil spring (helical compression spring). However, the constitution of the elastic element is not restricted to the illustrated one, and the elastic element may have a constitution such as a conical spring or a cylindrical rubber-like elastic body.

Reference numeral 29 represents a stopper for stopping an arm 23 of the bucket 21 in process of moving the transportation frame 26. The stopper 29 is provided in order to control a forward movement of the arm 23 by hooking the arm 23 with a roller 24 attached to a tip portion of the arm 23, and to cause a reverse movement of the bucket 21 around the inversion axis 22 as a center as a result of the forward movement of the transportation frame 26.

Further, reference numeral 38 represents a pressure-receiving element which can control a distance of the movement of the suspension apparatus 35 and at the same time can moderate a transmission of the impact energy, applied to the transportation frame 26 during dropping of the discards 14, to the extrusion pressing machine as a result of absorbing the impact energy through the deformation of the elastic body. Furthermore, the pressure-receiving element 38 has a constitution wherein a protective plate is adhered to both surfaces of the rubber-like elastic body, and is applied to a bottom surface of the guide frame 28.

Reference numeral 40 represents a recovering means for the discards 14 provided in a end position from which the forward transportation of the guide frame 28 is started. The discards 14 stored in the recovering means 40 can be again utilized in the production of the extruded products. Reference numeral 41 represents a guide plate, and reference numeral 42 represents a recovering container. Note, in the illustrated embodiment, that the storage of the discards 14 is carried out in a recovering container 42 which is installed on the floor which is the same as the floor of the instruments of the extrusion pressing machine, but when the extrusion pressing machine is provided in a pit, the recovering container 42 may be replaced with a means comprising a discard elevating or conveying apparatus capable of vertically conveying the discards 14 and a recovering container.

In addition, the illustrated embodiment of the present invention has a constitution using a direct operation type extrusion pressing machine. However, the present invention can be also applied to an indirect operation type extrusion pressing machine in which a die stem is attached to an end platen, or an extrusion pressing machine capable of carrying out both of the direct operation and the indirect operation.

Next, the function of the discard conveying apparatus having the constitution described above will be explained.

After completion of the extrusion of the billet (extruded product), a cylinder for transporting a container holder is operated to move the container, thereby causing a separation of the container from a dies 12, and then an extrusion stem is backwardly moved to the position in which the discard 14 is out of the container. Next, a cylinder of the shearing apparatus is operated to cause a downward movement of a blade of the shearing apparatus, thereby cutting and separating the discard 14 from the product. After completion of the cutting process, the extrusion pressing machine used is returned to a predetermined position of waiting and starting the extrusion.

After cutting and separating the discard 14 by using the shearing apparatus described above, the discard 14 is guided to a chute 13 and an apron 18, and is dropped through a discharging port 17 to a bucket 21. After confirmation of the fact that the vibration of the bucket 21 and the transportation frame 26 was stopped as a result of dropping of the discard 14 and that the discard 14 was contained in the bucket 21, pressure oil is supplied from a source of hydraulic pressure to a cylinder head side of the driving means 32 to cause a forward movement of the transportation frame 26. Then, a velocity of the forward movement of the transportation frame 26 is reduced at a predetermined position which is just before a roller 24 of the arm 23 attached to an inversion axis 22 is hooked and stopped by the stopper 29, while maintaining the forward movement. Under the condition in which the roller 24 is hooked and stopped by the stopper 29, a forward movement of a tip portion of the arm 23 is regulated, but a forward movement of the transportation frame 26 is continued, thereby starting a reverse movement of the bucket 21 around the inversion axis 22 as a center.

After the condition of hooking and stopping the roller 24 with the stopper 29 has attained, the transportation frame 26 is further forwardly moved, and stopped at a position of limiting a forward movement of the transportation cylinder. Then, the discard 14 is discharged from the reversed bucket 21. Herein, a turning angle of the bucket 21 is determined depending upon a transportation stroke ranging from the hooking and stopping point of the roller 24, appearing on a top portion of the arm 23, with the stopper 29, to the stopping point of limiting a forward movement of the transportation cylinder. As a result of the reverse movement of the bucket 21, the discard 14 is stored in a recovering container 42 of the recovering means 40. Note, as described above, that the recovering container 40 of the discard 14 should not be restricted to those described in the embodiment described above.

As used herein, it should be noted that the "forward movement" of the transportation frame 26 is intended to mean the direction at which the bucket 21 is transported from an inside of the extrusion pressing machine to an outside of the same machine, thereby discharging the discard 14, and that the "backward movement" of the transportation frame 26 is intended to mean the direction at which the bucket 21 is transported from an outside of the extrusion pressing machine to an inside of the same machine, thereby returning to a position at which the discard 14 can be dropped in the bucket 21.

After the transportation of the discard 14 from the bucket 21 to the recovering container 42 of the recovering means 40 was confirmed, pressure oil is supplied to the fluid pressure cylinder of the driving means 32 appearing in a side of a cylinder rod in order to backwardly move the cylinder rod. Then, the transportation frame 26 is moved to a position which is just below a discharging port 17 of the chute 13 in order to prepare the condition under which the subsequent step of dropping the discard 14 in the bucket 21 is carried out. A reverse state of the bucket 21 will be gradually returned to its original state as a result of the backward movement of the transportation frame 26 under the condition of hooking and stopping of the roller 24, appearing on a top portion of the arm 23, with the stopper 29.

As is understood from the above description of the embodiments of the present invention, according to the present invention, an opening portion is provided approximately just below the dies, the opening portion is provided with a chute for ensuring a free dropping of the discards, a bucket capable of reversing at its end position of the forward movement is provided for the purpose of containing the discards, and the bucket is horizontally provided in a direction crossing to the axis line in the machine base in the discard conveying apparatus. Therefore, according to the present invention, even if only a small dropping distance is applied to the discard conveying apparatus, it becomes possible to convey the freely dropping discards with a reliability from an inside of the extrusion pressing machine to an outside of the same machine without using a bulky machine base, and in addition, it becomes possible to provide a discard conveying apparatus provided with the extrusion pressing machine at a downsized scale and with a low instrument cost. Further, as the downsized conveying mechanism of the present invention is applied through the machine base, there is no necessity of providing a pit for disposing the instruments below the floor surface on which the extrusion pressing machine is disposed. Furthermore, a generation of the vibration and the impact noise can be diminished, because a suspension apparatus and a buffer means for absorb an impact energy of the dropping discards are contained in the discard conveying apparatus.

INDUSTRIAL APPLICABILITY

As is described in detail in the above paragraphs, using the discard conveying apparatus with the extrusion pressing machine according to the present invention, as a bucket for containing discards dropped through a chute is provided approximately just below a dies, the bucket is moved and conveyed to an outside of the extrusion pressing machine, and the discard conveying apparatus is disposed in a direction crossed to a direction of the axis line of the extrusion pressing machine in such a manner that the discard conveying apparatus is horizontally inserted into and guided through the machine base, it becomes possible to ensure a discharging operation of the discards to an outside of the extrusion pressing machine Without using a bulky machine base.

Further, as the discard conveying apparatus is downsized and the extrusion pressing machine is provided in such a manner that the machine is passed through the machine base, it is not necessary to provide a pit in which an instrument for recovering the discards is disposed below a floor surface on which the extrusion pressing machine is disposed.

Furthermore, as the discard is discharged from the bucket by turning, followed by reversing of the bucket when the bucket is moved to a position at which a bucket transporting means is guided to its end of the forward movement, there is no necessity for providing a means of transporting the discards to a position of recovering the discards, for example, a means of transporting the discards to a conveyer apparatus.

In addition, as the bucket is turned in such a manner that, in process of moving the bucket until a bucket transportation means is moved before its end of the forward movement, an arm provided to the inversion axis is hooked and stopped with a stopper in order to control the forward movement of the bucket, and then the bucket is turned through the hooked arm with the forward movement of the bucket transportation means, there is no necessity for providing a driving means of reversing the bucket, and thus it becomes possible to downsize and simplify the discard conveying apparatus and to reduce the cost of the machines installed.

Moreover, as the bucket in which the discard is contained is provided with a suspension apparatus capable of absorbing an impact energy of the dropping discard, it becomes possible to prevent a generation of the impacting sound and vibration when the discard is dropped in the bucket, to moderate an impact to the instruments in the discard conveying apparatus, and to reduce the generating noise, thereby improving a working environment. Further, as a pressure-receiving element consisting of a rubber-like elastic body is provided in a lower portion of the discard conveying apparatus, it becomes possible to absorb a dropping energy of the discard by the pressure-receiving element, thereby preventing the jumping out of the discard from the bucket and ensuring the reliable conveying of the discard.

The invention claimed is:

1. A discard conveying apparatus comprising a chute provided below a die of an extrusion pressing machine in which discards are freely dropped along the chute through which the discards are guided, in which said discard conveying apparatus comprises a machine base installed thereon:

a chute having a discharging port in a position which is approximately just under said dies, a bucket that contains said discards disposed in the discharging port of said chute, and a transporter capable of freely moving said bucket in a forward and backward direction, the transporter attached to the machine base in a direction of crossing to an axis line of the machine base while being passed through the machine base, and said bucket is turned and inversed by an inversion axis member thereof, supported by said transporter, when said bucket is transported to an end portion of the forward movement.

2. The discard conveying apparatus according to claim 1, wherein said bucket is subjected to a turning movement by stopping movement of an arm, one end of which is provided on the inversion axis member and another end of which is provided with a rotatable roller, by a stopper, fixed to a guide frame near an end portion of forward movement of said transporter outside of said extrusion pressing machine, in a process of moving said transporter and before arrival of said transporter at the end portion of the forward movement, followed by forwardly moving said bucket through rotation of the stopped arm, and reversely moving said bucket around the inversion axis member.

3. The discard conveying apparatus according to claim 1, wherein said transporter of the bucket comprises a buffer that absorbs dropping energy of said discards.

4. The discard conveying apparatus according to claim 3, wherein said buffer comprises a suspension apparatus for said bucket having an elastic element disposed in at least four corners of the transporter by which said inversion axis member is supported, and a pressure-receiving element comprising an elastic body disposed in a position below the discharging port of the chute and to which said bucket is contacted through said transporter, and said buffer absorbs dropping energy of the discards as a result of deformation of the elastic body.

5. The discard conveying apparatus according to claim 2, wherein said transporter of the bucket comprises a buffer that absorbs dropping energy of said discards.

6. The discard conveying apparatus according to claim 5, wherein said buffer comprises a suspension apparatus for said bucket having an elastic element disposed in at least four corners of the transporter by which said inversion axis member is supported, and a pressure-receiving element comprising an elastic body disposed in a position below the discharging port of the chute and to which said bucket is contacted through said transporter, and said buffer absorbs dropping energy of the discards as a result of deformation of the elastic body.

* * * * *